US009341327B2

(12) United States Patent
Sweeney

(10) Patent No.: US 9,341,327 B2
(45) Date of Patent: May 17, 2016

(54) INTEGRATED CARRIAGE LIGHTING SYSTEM FOR CONCRETE PAVERS

(71) Applicant: TEREX USA, LLC, Westport, CT (US)

(72) Inventor: John C Sweeney, Sioux Falls, SD (US)

(73) Assignee: Terex USA, LLC, Wetsport, CT (US)

( * ) Notice: Subject to any disclaimer, the term of this patent is extended or adjusted under 35 U.S.C. 154(b) by 305 days.

(21) Appl. No.: 14/156,794

(22) Filed: Jan. 16, 2014

(65) Prior Publication Data

US 2014/0204559 A1 Jul. 24, 2014

Related U.S. Application Data

(60) Provisional application No. 61/754,844, filed on Jan. 21, 2013.

(51) Int. Cl.
*F21L 13/00* (2006.01)
*E01C 19/48* (2006.01)

(52) U.S. Cl.
CPC ..... *F21L 13/00* (2013.01); *E01C 19/48* (2013.01); *E01C 2301/40* (2013.01)

(58) Field of Classification Search
CPC ..... F21L 13/00; E01C 19/48
See application file for complete search history.

(56) References Cited

U.S. PATENT DOCUMENTS

| | | | | |
|---|---|---|---|---|
| 1,865,134 | A | 6/1932 | Plimpton | |
| 3,565,382 | A | 2/1971 | Passarelli | |
| 4,021,991 | A | 5/1977 | Hotz | |
| 4,447,030 | A | 5/1984 | Nattel | |
| D275,450 | S | 9/1984 | Wegener | |
| D312,039 | S | 11/1990 | Smith | |
| 5,352,063 | A | 10/1994 | Allen et al. | |
| 5,555,694 | A | 9/1996 | Commins | |
| RE35,485 | E | 4/1997 | Stewart | |
| 6,273,378 | B1 | 8/2001 | Fu et al. | |
| 6,375,257 | B1 | 4/2002 | Wooding et al. | |
| 6,762,790 | B1 | 7/2004 | Matko et al. | |
| D608,625 | S | 1/2010 | Mercado | |
| 7,845,878 | B1 * | 12/2010 | Godbersen | E01C 23/07 404/72 |
| 8,042,776 | B2 | 10/2011 | Johnson | |
| 8,128,241 | B2 | 3/2012 | Bishop | |
| 8,166,991 | B2 | 5/2012 | Carter | |
| 2008/0197252 | A1 | 8/2008 | Clewett | |
| 2010/0215429 | A1 | 8/2010 | Raye et al. | |
| 2011/0031364 | A1 | 2/2011 | Kneshtel et al. | |
| 2011/0116213 | A1 | 5/2011 | Tai et al. | |
| 2011/0168857 | A1 | 7/2011 | Svedman et al. | |

* cited by examiner

*Primary Examiner* — David V Bruce
(74) *Attorney, Agent, or Firm* — Simmons Perrine Moyer Bergman PLC

(57) ABSTRACT

A concrete paver comprising a workbridge, which moves along a path to be paved. A carriage mounted on and reciprocating along a longitudinal axis of the workbridge, which is orthogonal to the path to be paved. A plurality of electrical lights disposed on and illuminating a surface which is fixed relative to the carriage, but variable or moving with respect to the workbridge. The electrical lights providing a substantially constant illumination to workers who work with the concrete surface as the carriage moves along the workbridge.

12 Claims, 3 Drawing Sheets

INTEGRATED CARRIAGE LIGHTING SYSTEM FOR CONCRETE PAVERS

BACKGROUND OF THE INVENTION

This invention relates to concrete paving equipment and, more specifically, to a lighting system that has been integrated into the concrete paving, finishing equipment and selected workbridge configurations to provide lighting at the concrete finishing site, and the area immediately surrounding the concrete finishing site.

Definitions

Concrete paving equipment is a self-powered machine, or set of self-powered machines, that have been designed to manipulate fresh concrete to apply surface finishing. This invention applies to all configurations of concrete paving and concrete surface finishing equipment.

Workbridge is a movable platform assembly that allows laborers and inspectors to access the full width of the concrete finishing site for secondary operations, without disturbing the finished concrete surface. This invention applies to selected configurations of workbridge.

The concrete finishing site is the area of fresh concrete on an existing concrete paving job that is presently being manipulated by the concrete paving machine, other concrete finishing machine, or selected workbridge configuration.

Concrete finishing operations include, but are not limited to, setting the fresh concrete to grade, consolidating the fresh concrete surface, smoothing the fresh concrete surface, applying a general surface finish to the fresh concrete surface, applying a contract-specific style of texturing, or applying a curing agent to the fresh concrete surface.

Light towers are self-contained, task-specific, electric generators powering attached, or detached, lighting sources that have been designed to provide wide area illumination.

A contractor-designed lighting system is a collection of light sources, mounting options, and a power source, selected by a contractor or a designee, to provide concrete finishing site lighting for safety and/or quality assurance.

The Lighting Requirement

Many of today's concrete paving contracts require the concrete paving contractor to perform around-the-clock operations, or only pave at night. Some concrete paving jobs dictate night paving due to environmental conditions, such as rain, ambient temperature and wind. Night paving operations may require the contractor to provide job-site lighting for quality control and safety purposes.

The site lighting options available to the concrete paving contractor may include, but are not limited to, light towers or a contractor-designed lighting system, usually consisting of a small commercial generator and high-current work lights, or possibly battery-operated lights.

Light Tower

Many concrete paving operations lack the appropriate locations for light towers, particularly when a new bridge is being paved, or when a portion of a highway or bridge is being rebuilt on an existing throughway that must be kept partially operating. If the light tower system is not carefully laid out and installed, it can interfere with traffic flow by partially illuminating the open throughway. The light tower option produces major shadows. This shadowing problem becomes more pronounced as the distance between the light tower and the concrete finishing site increases. The light tower rental, setup, breakdown and fueling require additional man-hours and increase job costs.

Contractor Designed Lighting System

The contractor-designed lighting system may consist of a stand-alone commercial generator mounted on the concrete paver and work lights. This option increases the weight of the concrete paver, and can add unwanted vibrations, either of which may become a problem on some paving operations. This option requires additional contractor resources to select, design, install, operate, and maintain the lighting system. All this manpower must be provided by the contractor.

Battery-Operated Lighting

The battery-operated lighting system may consist of a number of individual, battery-powered lights. Generally, these lights have minimal light output, and the battery life can become a problem. This option relies on the contractor to design, and fabricate, a mounting system for each style of light used. Replacing or charging batteries is an added task that must be assigned and performed.

SUMMARY OF THE INVENTION

The present invention comprises a lighting system, mounted to the concrete paving carriage, and is powered by the carriage engine electrical system.

The present invention components comprises a light mounting bracket, along with additional mounting plates, used to attach the lights to different models of the concrete paving carriage.

The low voltage, low-current, high-output lights are driven directly from the electrical system on the engine that powers the concrete paving carriage. This integrated lighting system option removes the generator/lighting system design requirements from the contractor, and provides more consistent lighting at the concrete finishing site. The setup and operation of the integrated lighting system comprises aiming the lights and enabling the power to the lights. There is little impact on the operating efficiency, weight or fuel economy of the concrete paving machine. Other jobsite lighting may still be required away from the concrete finishing site.

More specifically, an object of the invention is to provide an efficient, integrated lighting system to help contractors illuminate night paving operations at and around the concrete finishing site(s).

It is a feature of the present invention to integrate concrete finishing site lighting with the concrete paving and finishing machine(s) and selected workbridge configurations.

It is another feature of the present invention to integrate concrete finishing site lighting onto a moving carriage on a concrete paver.

It is another advantage of the present invention to improve safety at, and immediately around, the concrete finishing site(s).

It is another feature of the present invention to provide adequate concrete finishing site lighting that automatically moves with the concrete finishing operation(s).

It is another advantage of the present invention to provide adequate concrete finishing site lighting, with the minimum setup required by the concrete paving contractor.

It is another advantage of the present invention to provide the concrete paving contractor with an integrated lighting system, that can be easily removed and stored to help prevent vandalism and to add a level of theft protection.

It is another advantage of the present invention to provide the concrete paving contractor with an integrated lighting system that does not adversely affect the weight and operation of the concrete paving machine.

It is another feature of the present invention to provide the concrete paving contractor with an integrated lighting system that provides electrical protection for the carriage engine electrical system, as they relate to the lighting system.

It is another advantage of the present invention to provide the concrete paving contractor with an integrated lighting system that is easily configured to the existing, and future, concrete paving jobs.

It is another advantage of the present invention to provide the concrete paving contractor with an integrated lighting system that can be field-retrofitted to existing concrete paving/finishing machines and selected workbridge configurations.

BRIEF DESCRIPTION OF THE DRAWINGS

In the following description of the drawings, like reference numerals are employed to indicate like parts, in the various views. Please note that in some cases, hydraulic valves, hoses and electrical wiring have been deleted from the drawings to improve clarity.

DETAILED DESCRIPTION OF THE DRAWINGS

Figure 1:
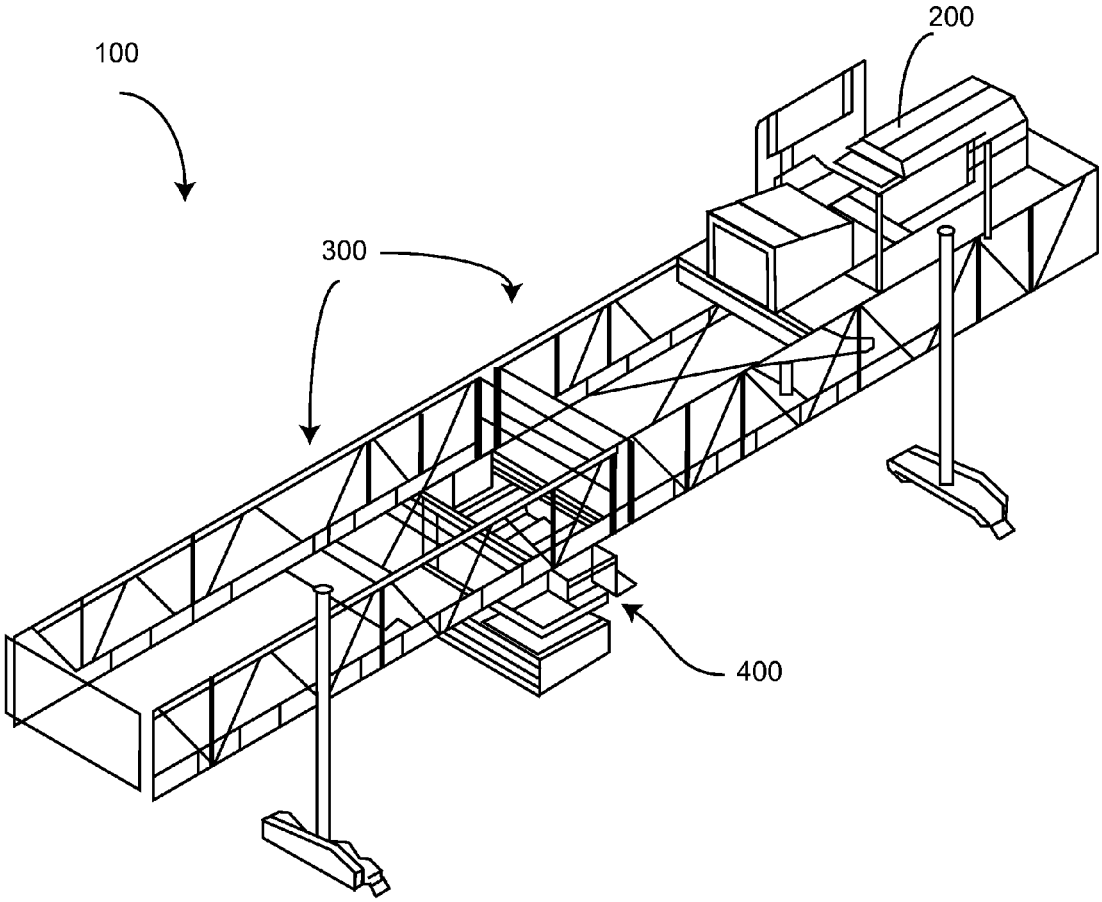
FIG. 1 is a perspective view of the integrated lighting system of the present invention, installed on one style of concrete paver/finisher.

In the following description of the drawings, like reference numerals are employed to indicate like parts, in the various views. Please note that in some cases, hydraulic valves, hoses and electrical wiring have been deleted from the drawings to improve clarity. Not all applicable configurations and uses of any automatic concrete paver/finisher, concrete paver carriage, concrete texture, concrete cure application or selected workbridge or their various uses are shown, but are considered to be included in this document by association.

FIG. 1 is a perspective view of one configuration of an automatic concrete paver/finisher, generally designated 100 with two sets of inserts 300, one type of concrete paver Power Unit 200 and one style of concrete paving carriage 400. Both the concrete paver 100 and the paving carriage 400 have an integrated lighting system installed. Note: there is no power cable that couples the carriage and the paver frame or workbridge frame, which carries power from off board the carriage onto the carriage, for the purpose of providing drive power to the lights. The lights may be LED or other low power, low current, high output lights, or any suitable incandescent or fluorescent lamps or the like.

Figure 2:
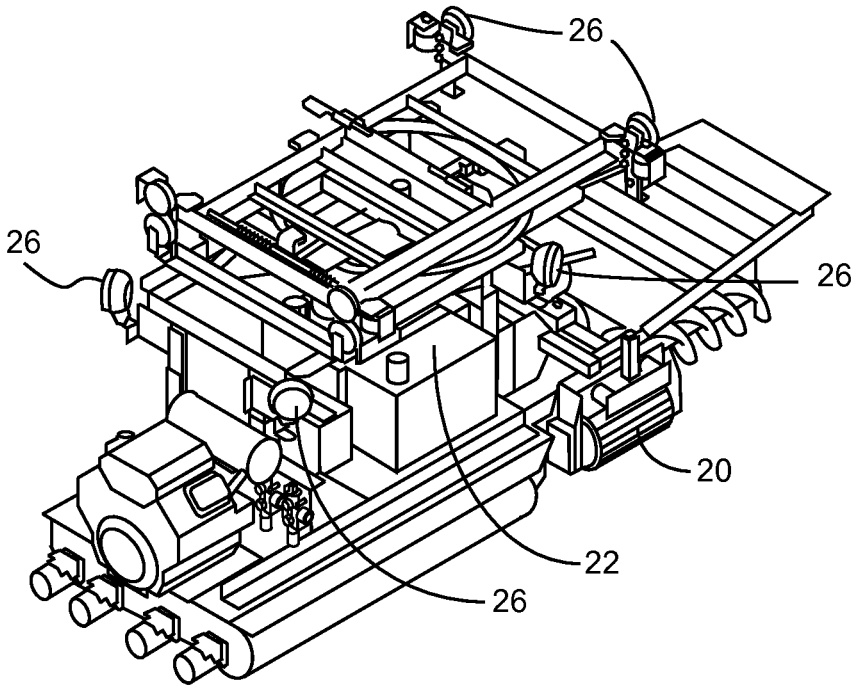
FIG. 2 is a perspective view of carriage style "X" with lights mounted, using a carriage plate and a light bracket.

FIG. 2 is a perspective view of carriage style "X", with generator 20, lighting control box 22, lights 26 and one representative orientation of a carriage plate and light bracket, with a light source attached. Generator 20 may be a prior art generator of the type used in the past to provide power to operate the carriage in normal conditions. With LED lighting, little additional power will be needed to power the lights during operation. The lights 26 will preferably be located and positioned so as to illuminate the current concrete finishing site. In a preferred embodiment, the lights 26 may have an automatically variable positioning and/or control mechanism, such that as the carriage approaches an end of the paver, the lights can change their relative direction, or intensity of illumination, so as to reduce the amount of illumination that occurs on areas outside the concrete finishing site, especially any adjacent lanes of traffic, where illumination may be undesirable. Various means for automatically adjusting the direction or intensity of lights 26 could be used. For example, the means for controlling the relative direction and intensity of lights 26 may be completely located within the lights 26, which could be internally steerable and dimmable in response to a control signal from the lighting controls 22. Alternatively, the lights 26 could be mounted on a spring loaded rotating connection and/or have a lighting lens louver, which is physically and variably moved by increasing contact with a member disposed off-board the carriage.

Figure 3:
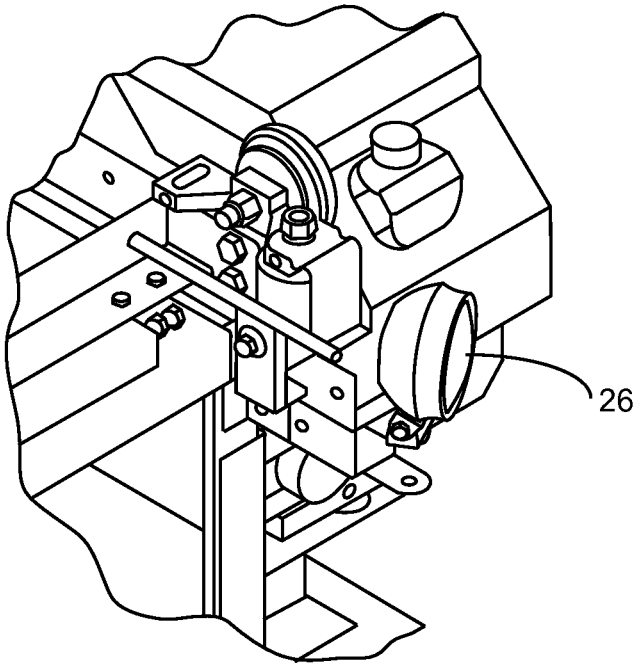
FIG. 3 is a detailed perspective view of a mounting method on carriage style "X".

FIG. 3 shows a representative orientation for mounting a carriage plate and light bracket with light source to carriage style "X".

It is thought that the method and apparatus of the present invention will be understood from the foregoing description, and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. A concrete paver comprising:

a mobile workbridge, having a longitudinal axis, which is configured to move along a path which is to be paved with concrete, where said path is substantially orthogonal to said longitudinal axis;

a concrete contacting carriage, coupled to said workbridge and configured to reciprocate along said longitudinal axis; and a plurality of electrical lights disposed, oriented and configured to:

be transported along said path with said workbridge;

illuminate a work area which is moving, relative to said workbridge; and said work area, further being in synchronization with said concrete contacting carriage, as it reciprocates along said longitudinal axis.

2. The concrete paver of claim 1 wherein said plurality of electrical lights are exclusively powered by a source of electrical power disposed on said concrete contacting carriage.

3. The concrete paver of claim 2 further comprising means for maintaining said synchronization.

4. The concrete paver of claim 3 wherein said means for maintaining synchronization comprises:

a plurality of mounts, each of which is coupled to one of said plurality of electrical lights, and also coupled to said concrete contacting carriage, so that said plurality of electrical lights reciprocate with said concrete contacting carriage.

5. The concrete paver of claim 1 further comprising a plurality of workbridge mounted electric lamps, being mounted so as to be angled downwardly from said workbridge, at a first average predetermined angle with respect to said horizontal reference; said plurality of electric lights being mounted so as to be angled downwardly, at an average second average angle, with respect to a horizontal reference; wherein said first average angle is greater than said second average angle.

6. A concrete paver comprising:

a concrete paver workbridge, having a longitudinal axis;

a carriage coupled to said workbridge; and a plurality of electric lights coupled to, and carried by, said carriage, which are sized, located, oriented and configured to provide work lighting for concrete paving workers performing tasks in a moving work area, which reciprocates along said longitudinal axis.

7. The concrete paver of claim 6 further comprising a generator disposed on said carriage.

8. The concrete paver of claim 7 wherein said plurality of electric lights are exclusively powered by said generator.

9. A method of illuminating a road, in the process of being paved with concrete, comprising the steps of:

providing a concrete paver with a workbridge, a reciprocating carriage, coupled to and movable, along a longitudinal axis of the workbridge, a plurality of electric lights, and a workbridge generator; and directing said plurality of electric lights so as to project consistent illumination upon a moving work area, defined by a proximity characteristic with respect to said reciprocating carriage.

10. The method of claim 9 wherein said step of directing said plurality of electric lights comprises mounting said plurality of electric lights on said reciprocating carriage, and orienting said plurality of electric lights to illuminate predetermined locations, defined by proximity to said reciprocating carriage, and reciprocating said carriage.

11. The method of claim 9 further comprising a carriage mounted generator, and wherein said plurality of electric lights are powered exclusively by said carriage mounted generator.

12. The method of claim 9 further comprising the steps of:

providing a plurality of workbridge electric lamps which are pointed downwardly.

* * * * *